United States Patent [19]

Raab et al.

[11] 4,188,796

[45] Feb. 19, 1980

[54] METHOD OF AND APPARATUS FOR THE COOLING (QUENCHING) OF CRACKING GASES

[75] Inventors: Markus Raab, Munich; Hans P. Langebach, Pullach; Heiner Dittmann, Munich, all of Fed. Rep. of Germany

[73] Assignee: Linde Aktiengesellschaft, Wiesbaden, Fed. Rep. of Germany

[21] Appl. No.: 842,290

[22] Filed: Oct. 14, 1977

[30] Foreign Application Priority Data

Oct. 15, 1976 [DE] Fed. Rep. of Germany ..... 2646691

[51] Int. Cl.[2] ..... F28C 1/00

[52] U.S. Cl. ..... 62/121; 208/101; 208/341

[58] Field of Search ..... 208/101, 48 Q, 341; 260/683 R, 674; 261/177; 202/95, 227, 228, 253; 62/121, 304, 310

[56] References Cited

U.S. PATENT DOCUMENTS

| | | | |
|---|---|---|---|
| 2,297,675 | 10/1942 | Dayhuff et al. | 208/341 |
| 2,339,680 | 1/1944 | Carney | 208/341 |
| 3,027,726 | 4/1962 | Green | 62/121 |
| 3,098,362 | 7/1963 | Sohda et al. | 62/78 |
| 3,342,724 | 9/1967 | Goering | 208/101 |
| 3,630,887 | 12/1971 | Mounce et al. | 208/48 Q |

FOREIGN PATENT DOCUMENTS

| | | | |
|---|---|---|---|
| 1095906 | 12/1954 | France | 62/121 |

*Primary Examiner*—Lloyd L. King
*Attorney, Agent, or Firm*—Karl F. Ross

[57] ABSTRACT

Cracking gases are cooled by spraying them through a multiplicity of orifices into a cooling oil bath below the surface thereof.

10 Claims, 8 Drawing Figures

METHOD OF AND APPARATUS FOR THE COOLING (QUENCHING) OF CRACKING GASES

FIELD OF THE INVENTION

The present invention relates to a method of and to an apparatus for cooling of cracking gases with a cooling oil and, more particularly, to the rapid reduction in the temperature of cracking gases to prevent secondary reactions therein.

BACKGROUND OF THE INVENTION

In plants for the recovery of ethylene and other unsaturated hydrocarbons from the cracking of a petroleum feed stock, the petroleum fractions which are used and are subjected to the pyrolysis process can have a higher boiling point than naphtha in many cases.

The use of, for example, gas oil as the feed stock for the pyrolysis process, has already been recognized to result in significant technological problems. In the pyrolysis of naphtha and lighter feed stocks, it is customary to quench the the reaction gas stream (cracking gas) upon its discharge from the cracking furnace by indirect cooling with generation of high pressure steam as rapidly as possible so that the heat recovery will be as high as possible and undesired secondary reactions can be avoided. Reference may be had in this regard to pages 429 ff, of the *Chemical and Process Technology Encyclopedia;* Considine, Editor, McGraw-Hill Book Company, New York, 1974.

Subsequent cooling is carried out usually by the direct spraying of oil generated in the cracking process into the cracking-gas stream.

It has been found that the quenching of gas oil cracking gases gives rise to a high degree of polymerization and carbon deposition even at high temperatures. In other words, in spite of the fact that a quenching is carried out, the quenching operation remains susceptible to the production of polymers of the unsaturated hydrocarbons contained in the cracking gas and carbonization of the surfaces of the reactor, i.e. cokefication.

Heat abstraction by indirect cooling is limited by the short residence time the cracking gas can be present in the reactor without carbonization or carbon deposition, and is not possible when the starting materials for the cracking operation are very heavy hydrocarbons or like feed stocks.

Thus the greater part of the heat abstraction from the gas stream must be effected by direct spraying of oil into it in accordance with prior art teachings. In the latter case, however, the cooling-oil droplets come into contact with the tube walls in the presence of hot cracking gases and carbonization of these walls can occur. German open application DT-OS No. 2,062,937, for example, describes a technique whereby the cooling oil is so introduced into the cracking gas duct that a film of cooling oil is formed on the tube wall and hence a three-phase interface is not permitted to develop between the cracking gas, the spraying liquid, and the tube wall. This has the tendency to reduce the degree of carbonization of the wall. However, it is not always possible to maintain the continuity of such a cooling oil film so that there are occasions at which the three-phase interface will develop and coke or carbon accumulations on the wall can be found when the cooling oil contacts the wall in the presence of the hot cracking gases.

OBJECT OF THE INVENTION

It is the principal object of the invention to provide a method of and an apparatus for the cooling (quenching) of reaction gases, particularly cracking gases derived from the steam cracking of ethane, propane or paraffinic or naphthenic hydrocarbons or like petroleum feed stocks, to produce ethylene and other unsaturated hydrocarbons, whereby carbon deposition is avoided as much as possible.

It is another object of this invention to provide an improved method of an apparatus for the quenching or cooling of cracking gases whereby the disadvantages of an earlier systems are avoided and which are efficient and economical.

SUMMARY OF THE INVENTION

These objects and others which will become apparent hereinafter, are attained in accordance with the present invention, by introducing the cracking gas stream into a cooling-oil bath below the liquid level thereof and preferably from a plurality of orifices which distribute the cracking gas in this bath.

This system avoids the simultaneous contact of the cooling oil, the hot wall of the reaction vessel and the hot cracking gases which has hitherto been the principal cause of cokefication on the walls of the cooling apparatus and hence precludes carbon deposition.

It has been found to be especially important, to this end, to introduce the cracking gas into the cooling-oil bath through a gas distributor which opens completely below the liquid level of the cooling oil bath. Because of this distribution, the cooling process has been found to be highly effective, the rising gas bubbles and the cooling oil bath undergoing an intensive heat exchange at the surfaces of the bubbles.

By simply varying the level of the liquid of the cooling bath, i.e. the distance through which the bubbles must pass from the distributing system of the surface of the cooling oil, the operating conditions can be modified to bring about optimum cooling. For example, by simply raising the liquid level, the path of the cooling gases through the cooling liquid is increased in length and the contact time between the cracking gas and the cooling liquid is increased, thereby increasing the degree to which tha gas is cooled.

To prevent the cooling oil from feeding back into the duct system though which the cracking gas is introduced into the cooling oil bath, the cracking gas is fed into the cooling oil at a speed (velocity) such that the flow-characteristic Froude number and the Weber number are each held in excess of four. Hence, the Froude number F and the Weber number W must both exceed 4 in this preferred embodiment of the invention.

The Froude and Weber numbers are given by the relationships:

$$\text{Froude number}: F = \frac{W^2 d \cdot \rho G}{d \cdot g \cdot \rho L} > 4,$$

$$\text{Weber number}: W = \frac{W_d \cdot \rho\, G \cdot d}{\sigma} > 4$$

In the foregoing equations:

$W_d$=cracking gas velocity at the discharge orifices below the level of the cooling oil bath.

d=diameter of breadth (in case the opening is non-circular) of the discharge orifices g=the acceleration of gravity
G=density of the gas
pL=liquid specific gravity
$\sigma$=surface tension of the liquid.

In addition, it has been found to be possible, by an appropriate choice of the dimensions and configurations of the discharge openings, to make the flow velocity of the cracking gases in the discharge openings greater than the flow velocity in the supply system. Note that this can be readily achieved by providing that the total flow cross-section of all of the orifices opening below the level of the liquid bath is less than the flow cross-section of the duct feeding these orifices. This has been found to ensure exclusion of the cooling liquid from entry into the cracking gas duct.

It has been found further that a high velocity of the cracking gas at the orifices brings about an entrainment of any small particles of carbonaceous material which may be found in the cracking gas and causes these particles to be dispersed by the gas-distribution system.

The distribution system itself is rendered free from accumulations or incrustation by the self-cleaning effect of the high velocity gas.

According to a feature of the invention, which has been found to be particularly advantageous, the cracking gas is subjected, following the quenching in the bath of cooling oil, to further cooling in a column provided with a plurality of bottoms or plates and serving as a material and/or heat exchange column.

As a result, the cracking gases rising in the liquid bath pass upwardly in counterflow to the downwardly flowing cooling oil which can collect in the bath. The exchange bottoms or plates of the column ensure an intimate contact between the cracking gas and the cooling liquid and thus raise the cooling efficiency.

The process of the present invention is thus best carried out in an apparatus that constitutes a receptacle for the cooling oil bath and which is provided with a gas distributor system having at least one cracking gas duct which has at least one opening on its underside and a closed end. This duct can distribute the cracking gas through a plurality of discharge openings into the cooling oil bath to effect an especially high degree of heat-exchanging contact between the cooling oil and the cracking gas.

Best results are obtained when the discharge orifices are turned downwardly and in the case in which the discharge orifices are provided on the underside of the horizontal gas-feed system as round bores, generally of circular configuration. Especially when tubes of different diameters form the distribution system, care must be taken to see that all of the orifices lie along the same geodetic line so that the same cracking gas throughput is maintained at all of the discharge orifices.

It is also possible, in accordance with the present invention, to use longitudinally extending slots as the discharge orifices instead of the circular bores mentioned previously. The slots have lesser a tendency toward blockage by carbonaceous particles which may be entrained in the cracking gas stream.

The latter embodiment has been found to be especially effective when, because of the operating conditions of the cracking furnace, the gas entering the cooler is already known to contain coke or like solid carbonaceous particles. Even under these circumstances, the danger of blockage of the discharge orifices or openings is small.

When it is desired to have the gas pass through an exchange column with a plurality of stages, bottoms or plates, this column is mounted directly upon the receptacle for the oil bath and above the latter.

It has been found to be advantageous to provide between the container for the oil bath and the exchange column, a frustoconically upwardly converging transition duct which may be formed internally with a distributor body, e.g. another frustoconical member. The latter serves to deflect the descending liquid along the wall of the container for the oil bath so that an adherent oil film is provided on this wall to protect the latter against caking up with carbonaceous materials.

The construction has been found to be especially advantageous for the cooling process of the present invention which is carried out at temperatures of the cracking gases immediately above the liquid level in the bath that may, under certain operating conditions, still be sufficiently high that carbonization and coke deposition cannot be completely excluded.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
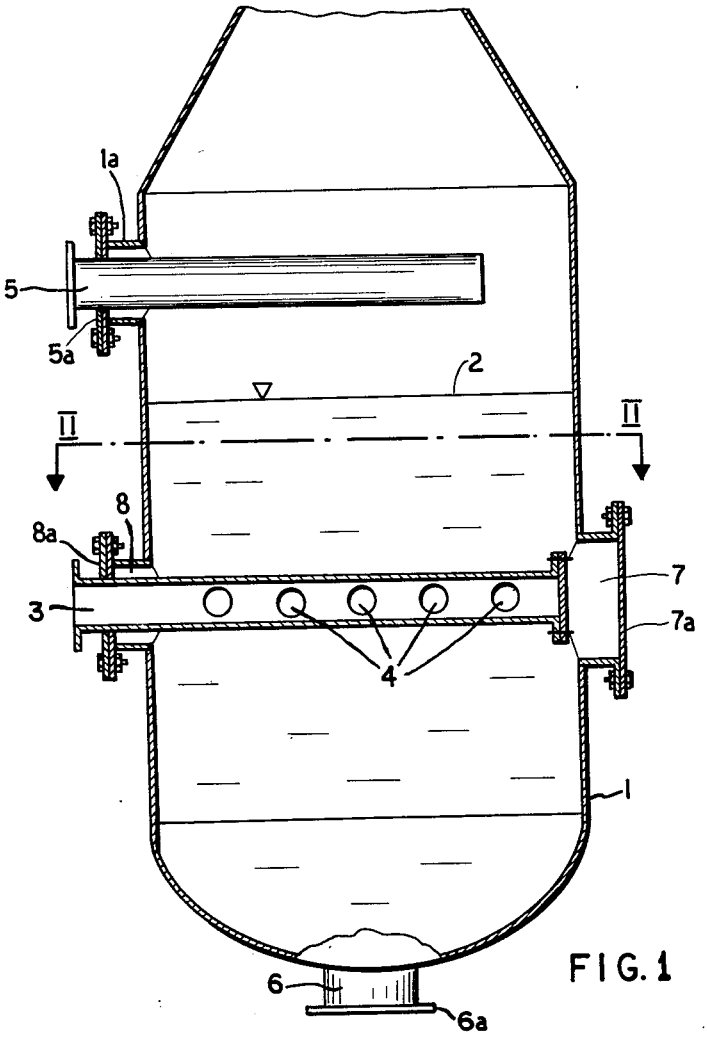
FIG. 1 is a longitudinal cross-sectional view, partly in diagrammatic form, of an apparatus for carrying out the process of the present invention, namely, the quenching of a cracking gas arriving from a petroleum feed stock cracking reactor or furnace.
Figure 3:
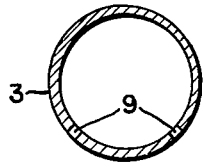
FIG. 3 is a cross-sectional view taken along the line III—III if FIG. 2.
Figure 4:
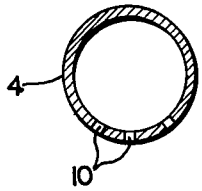
FIG. 4 is a cross-sectional view taken along the line IV—IV of FIG. 2.
Figure 2:
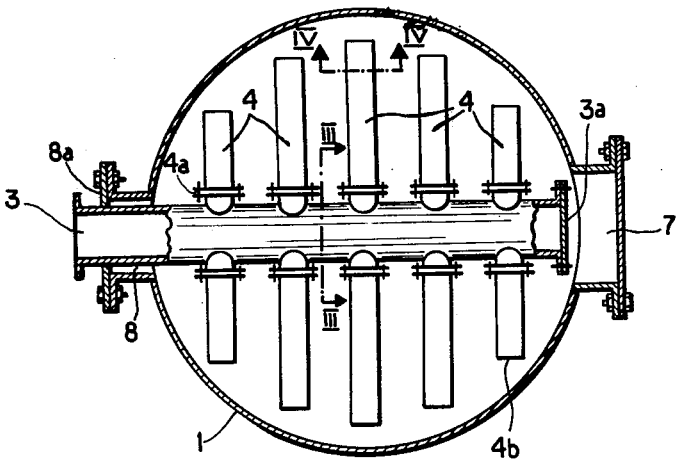
FIG. 2 is a cross sectional view taken along the line II—II of FIG. 1.

FIGS. 1 through 4 show a receptacle containing a bath of cooling oil having an upper surface or liquid level 2 which can be varied in accordance with the duration of contact between the bubbles of the cracking gas and the liquid. The cracking gas is introduced through a pipe 3 into the cooling apparatus and flows to smaller pipes 4 which branch from the pipe 3 and can be connected thereto by flanges 4*a*. The pipe 3 is sealed in a plate 8*a* covering the flange 8 and is closed at its end within the receptacle 1 by a flange 3*a*. The ends 4*b* of the smaller diameter pipes 4 are also closed. On the undersides of the pipes 3 and 4, there are provided circular discharge orifices or bores 9 or 10 through which the cracking gas is dispersed in the cooling oil. Some 900 discharge orifices can be provided in the embodiment illustrated in FIGS. 1 and 2.

Fresh cooling oil is introduced via a duct 5 into the receptacle 1, the duct 5 being sealed in a plate 5a of a fitting 1a of the receptacle. A discharge fitting 6 at the bottom of this receptacle has a flange 6a which enables it to be connected to an oil-circulating pump or the like, the oil passing from the container 1 via the fitting 6.

An access fitting 7 closed by a plate 7a which can be bolted to the flange of the fitting 7, enables access to the gas distributor 3,4 in the vessel. When the plate 8a is removed, e.g. by disconnecting the bolts affixing it to the flange of fitting 8, the entire distributor can be withdrawn from the vessel.

Figure 5:
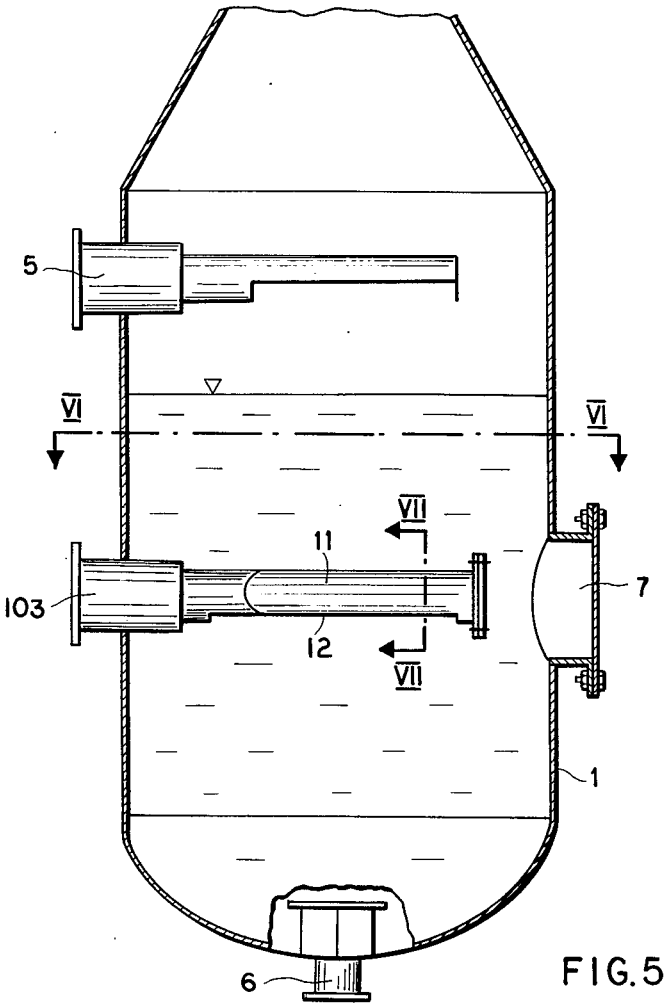
FIG. 5 is a view similar to FIG. 1 showing a different distribution system for feeding the cracking gases into the cooling-liquid bath.
Figure 7:
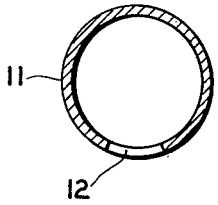
FIG. 7 is a cross-sectional view taken along the line VII—VII of FIG. 5.
Figure 6:
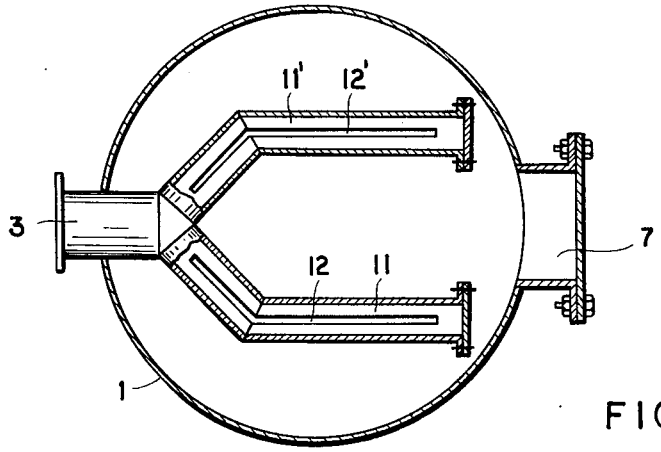
FIG. 6 is a cross-sectional view taken along the line VI—VI of FIG. 5.

The embodiment of FIGS. 5 through 7 differs from that of FIGS. 1 through 4 in various respects but most significantly by providing a distributor connected to the inlet duct 103 for the cracking gas, which consists of two parallel pipes 11 and 11'. The distribution orifices are here formed as longitudinally extending slots 12 and 12' of the underside of the pipes 11 and 11' and best seen in FIGS. 6 and 7.

Figure 8:
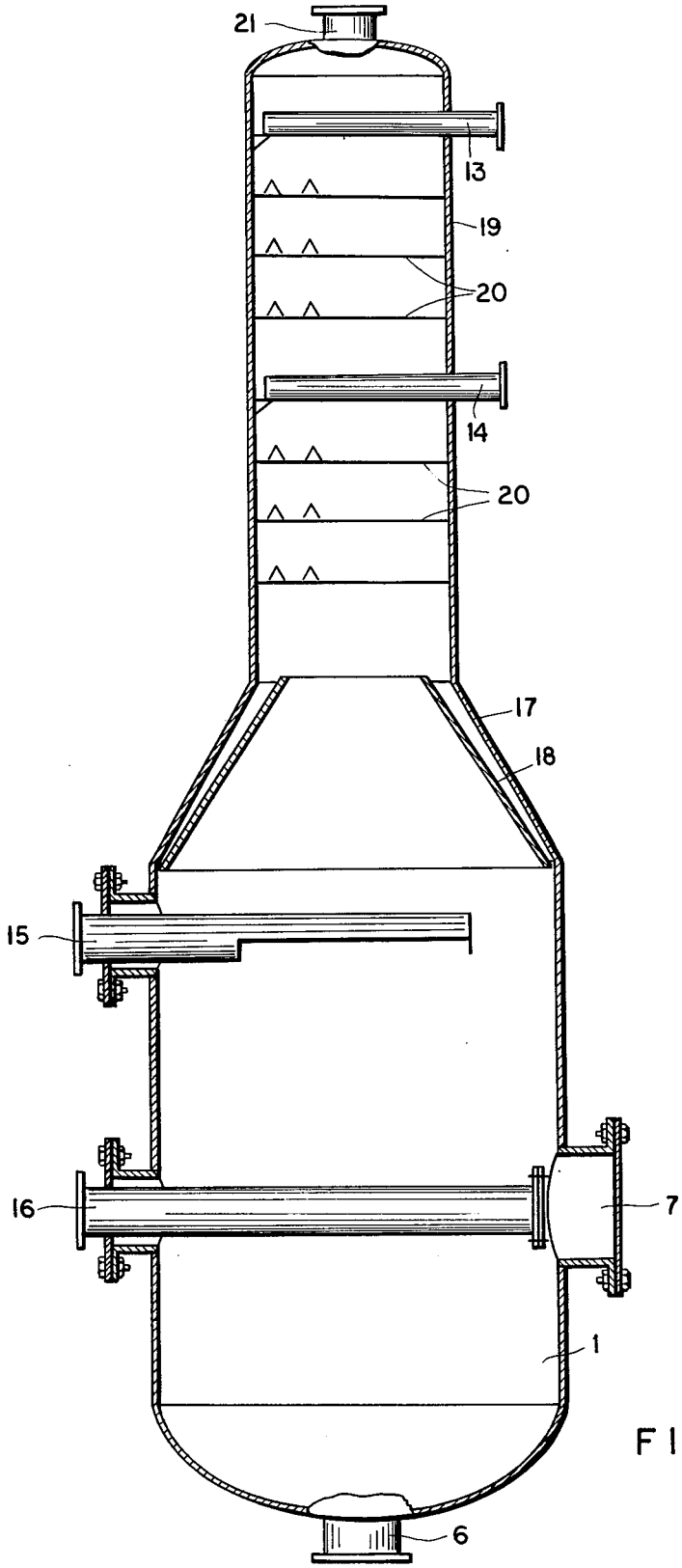
FIG. 8 is a view similar to FIGS. 1 through 5 showing an apparatus of the present invention provided with an exchange column serving for the subsequent cooling of the cracking gas stream after it has emerged from the cooling-oil bath.

FIG. 8 illustrates an apparatus for carrying out the process of the present invention which comprises a receptacle 1 of the type described, for example, in connection with FIGS. 1 through 4 and supplied with the cracking gas at the distributor 16 while fresh oil is fed through the pipe 15. Above the oil bath in this embodiment, however, there is provided a frustoconically upward converging duct 17 which forms a transition piece between the receptacle 1 and a column 19 disposed thereabove. A distributor 18 disposed within the duct 17 serves to guide descending liquid along the wall of the vessel 1 to form a coating of the cooling oil thereon.

The cracking gas bubbles through the bath of liquid in the vessel 1 and then rises through the bubble-cap trays 20 in the column which can be supplied with fresh cooling oil via the pipes 13 and 14. The cooled cracking gas is withdrawn from a fitting 21.

On each of the bubble trays of the column, the gas passes in direct heat-exchanging relationship with the downwardly flowing oil.

The bubble cap trays 20 make the heat exchange contact between the cooling oil and the cracking gas more intensive.

SPECIFIC EXAMPLE

A cracking gas containing ethylene flows from a pyrolysis furnace with a mass-flow density of about 30 kg per cm sq. per second at a pressure of 1.6 bar and a temperature of 850° K., via the pipe 16 and is dispersed in the cooling oil bath (FIG. 8).

Cooling oil is introduced through the pipes 13, 14 and 15 at a rate of 120 meters$^3$ per hour. The cooling oil is a hydrocarbon mixture having an average molecular weight of 290.

About 20 meters$^3$ per hour of cooling oil flows downwardly and is distributed by the member 18 along the wall of the vessel 1 uniformly so that an oil film of about 3 mm thick is provided.

The cracking gas, at the junction between the column 19 and the tank 1, has a temperature of 540° K. and is cooled to 470° K. at the discharge fitting 21 of this column.

The system was found to cool the cracking gas with practically no secondary or polymerization reactions and the system was operated free from any accumulation of coke or carbonaceous material.

I claim:

1. A method of cooling a reactive cracking gas with a cooling oil, comprising dispersing said reactive cracking gas in a cooling-oil liquid bath below the level thereof, said cracking gas being dispersed in said bath by feeding it through a plurality of orifices at a velocity such that its Froude and Weber numbers are each greater than 4.

2. A method of cooling a reactive cracking gas with a cooling oil, comprising dispersing said reactive cracking gas in a cooling-oil liquid bath below the level thereof, and passing the cracking gas emerging from said bath upwardly through a tray column while passing at least some cooling oil downwardly therethrough and in direct heat exchange with the cooling oil in said column.

3. The method defined in claim 2 wherein said bath is received in a receptacle, further comprising the step of distributing the descending cooling oil along the wall of said receptacle until it reaches said bath, thereby forming a uniform layer of cooling oil on the wall of said receptacle.

4. An apparatus for the cooling of a cracking gas with a cooling oil, comprising:

a receptacle receiving a bath of said cooling oil;

distributing means in said receptacle below the level of said bath and formed with a plurality of downwardly open orifices for dispersing said cracking gas in said bath;

means for withdrawing cold cracking gas from said receptacle;

means for introducing cooling oil into said receptacle to form said bath, said distributor including at least one pipe extending into said receptacle and having a closed end therein.

5. The apparatus defined in claim 4 wherein said distributing means includes a feed pipe for supplying said cracking gas to said orifices and said orifices have a total discharge cross section less than the flow cross section of said feed pipe.

6. An apparatus for the cooling of a cracking gas with a cooling oil, comprising:

a receptacle receiving a bath of said cooling oil;

distributing means in said receptacle below the level of said bath and formed with a plurality of downwardly open orifices for dispersing said cracking gas in said bath;

means for withdrawing cold cracking gas from said receptacle;

means for introducing cooling oil into said receptacle to form said bath, said distributor including at least one pipe extending into said receptacle and having a closed end therein; and a tray column disposed above said receptacle and communicating with the means for discharging cracking gas from said receptacle, said column being provided with a plurality of trays and means for feeding cooling oil onto said trays, the cooling oil descending in said column into said bath.

7. The apparatus defined in claim 6 wherein said pipe is formed with a plurality of circular bores on a lower surface of the pipe to form distributing orifices discharging said gas into said bath.

8. The apparatus defined in claim 6 wherein said orifices are constituted by at least one longitudinal slit.

9. The apparatus defined in claim 6 wherein said means for discharging said gas from said receptacle includes a frustoconical transition piece connecting said receptacle with said column.

10. The apparatus defined in claim 9 further comprising a frustoconical distributor within said transition piece for distributing descending cooling oil onto a wall of said receptacle to form a uniform layer of cooling oil therein as said oil passes from said column into said bath.

* * * * *